US006676445B2

(12) United States Patent
Hall et al.

(10) Patent No.: US 6,676,445 B2
(45) Date of Patent: Jan. 13, 2004

(54) COAXIAL CABLE CONNECTOR APPARATUS, METHODS AND ARTICLES OF MANUFACTURE FOR ANGLE OR IN-LINE APPLICATIONS

(75) Inventors: John W. Hall, Harrisburg, PA (US); James M. Raudenbush, Halifax, PA (US); Douglas J. Hardy, Middletown, PA (US); Keith R. Foltz, Oberlin, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/056,700

(22) Filed: Jan. 25, 2002

(65) Prior Publication Data

US 2003/0143893 A1 Jul. 31, 2003

(51) Int. Cl.[7] ..... H01R 9/05
(52) U.S. Cl. ..... 439/582
(58) Field of Search ..... 439/582, 578, 439/63, 394

(56) References Cited

U.S. PATENT DOCUMENTS 2,152,504 A * 3/1939 Scott et al. ..... 174/19
2,238,834 A * 4/1941 Travers ..... 174/88 C
3,047,828 A * 7/1962 Gregson et al. ..... 439/248
3,480,722 A * 11/1969 Van Horssen et al. .... 174/75 C
4,655,534 A * 4/1987 Stursa ..... 439/582
4,881,912 A * 11/1989 Thommen et al. ..... 439/582
4,932,898 A * 6/1990 Goodman et al. ..... 439/582
5,316,499 A * 5/1994 Scannelli et al. ..... 439/534
6,361,348 B1 3/2002 Hall et al.
6,450,829 B1 9/2002 Weisz-Margulescu

FOREIGN PATENT DOCUMENTS

EP 0 090 538 A2 * 5/1983 ..... 439/582

* cited by examiner

*Primary Examiner*—Tho D. Ta

(57) ABSTRACT

Apparatus, methods and articles of manufacture for a coaxial cable connector that allows variable wire termination orientations are disclosed. A connector housing is used to install the embodiments upon a mating connector, with a cable housing providing contact for a coax cable. A core member provides connection for an inner conductor, and a cap is used to seal the connector, once the cable is installed within the cable housing.

20 Claims, 5 Drawing Sheets

COAXIAL CABLE CONNECTOR APPARATUS, METHODS AND ARTICLES OF MANUFACTURE FOR ANGLE OR IN-LINE APPLICATIONS

FIELD OF THE INVENTION

The present invention generally relates to articles of manufacture, apparatus and methods for coaxial cable connectors. More particularly, this invention relates to articles of manufacture, apparatus and methods for radio frequency coaxial connectors.

BACKGROUND OF THE INVENTION

Radio frequency (RF) coaxial cable connectors are used for numerous automotive navigation and communication systems applications, such as global positioning systems (GPS), car radio, mobile phone, after-crash management, and multimedia. The configuration of any given connector may depend on a number of requirements, such as wire termination configuration, (cable to cable connectors, cable to printed circuit board connectors, etc.), operational, performance and space requirements. For example, a specific automotive application may require a right angle, crimping-type SMB connector with 50 ohm impedance.

Soldering or crimping is generally used to install a connector on a cable. Crimping is more commonly used, as a connection can usually be crimped more easily than soldered. However, soldering may be used where a more secure connection is desired. Insofar as cable-connector installation means (i.e. soldering or crimping) may be changed by the end user as desired, it would be beneficial to have a connector that is adaptable to either installation means.

Whether soldering or crimping is chosen, connector installation may be complicated by installation on an angle. For example, a soldering configuration may require soldering a wire to the terminal at an angle, which may be a more intricate process than soldering parallel connections. If a crimping configuration is used, however, the process may be complicated insofar as crimping on an angle may require using a terminal that has two sections, one section for termination to the wire and one section at an angle for the connector interface, thus complicating installation. Moreover a crimping connection may result in a less secure connection than a soldering connection. Accordingly, it would be beneficial to have a coaxial cable connector that simplifies the soldering process for angle terminals.

In addition to angle connectors, in line connectors are used as well to fasten cables to connectors. Here, too, it would be beneficial to have an installation means that could accommodate either crimping or soldering.

Whichever installation means is chosen, it would be beneficial to have a sealed connection so that the electrical connection is secure. Sealing may be done in a number of ways, however, a simple seal mechanism would be extremely beneficial for ease of installation.

Additionally, installation of a connector on a cable, besides a soldering or crimping step, and sealing step, may include a plating step. Therefore, it would be beneficial to have a means by which plating can occur, and excess plating can be drained off easily.

Accordingly, it is an object of the present invention to provide an improved coaxial cable connector.

It is a further object of the present invention to provide an improved coaxial cable connector that permits crimping or soldering connections.

It is a further object of the present invention to provide an improved coaxial cable connector that permits crimping or soldering connections for angled or in line applications.

SUMMARY OF THE INVENTION

The summary, as well as the following detailed description of the invention, will be better understood when read in conjunction with the appended drawings. For the purpose of illustrating the invention, there are shown in the drawings, certain embodiment(s) which are presently preferred. It should be understood, however, that the invention is not limited to the precise arrangements and instrumentalities shown.

The present invention comprises articles of manufacture, apparatus and methods for an improved coaxial cable connector that permits crimping or soldering connections for angled or in line applications.

The preferred embodiment comprises a connector housing, cable housing, core member and cap. The connector housing provides for an interface with a mating connector, such as jack, plug, etc., and is accordingly configured to be compatible with that mating connector. The cable housing provides an installation interface for the cable. The core member provides the electrical contact for the inner cable conductor. The cap seals the assembly once the cable is installed onto the connector.

Additional objects, advantages and novel features of the invention will be set forth in part in the description and figures which follow, and in part will become apparent to those skilled in the art on examination of the following, or may be learned by practice of the invention.

DETAILED DESCRIPTION OF THE PREFERRED EMBODIMENTS

Reference is now made to the accompanying Figures for the purpose of describing, in detail, the preferred embodiments of the present invention. The Figures and accompanying detailed description are provided as examples and are not intended to limit the scope of the claims appended hereto.

Figure 1:
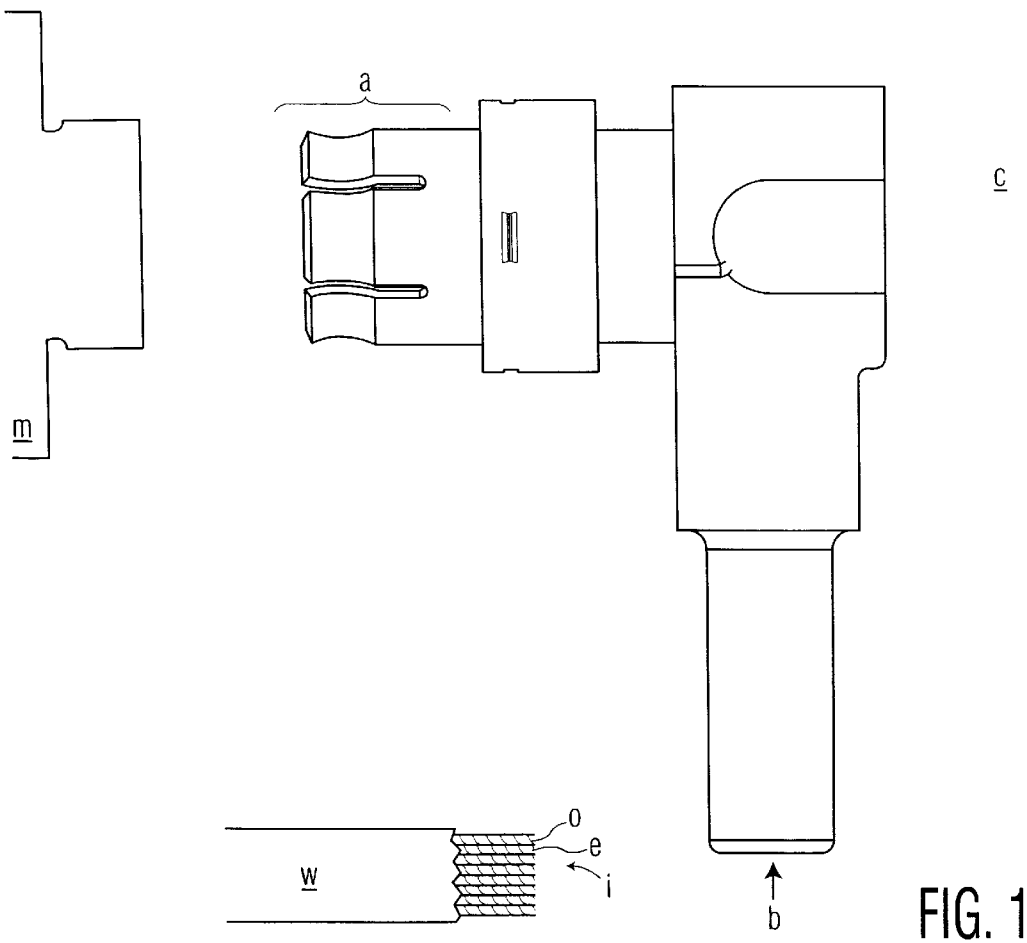
FIG. 1 shows a view of a preferred embodiment of the present invention.

FIG. 1 shows a preferred embodiment of the present invention wherein cable termination is at a 90 degree angle from a mating connector. Other embodiments, it should be noted, may be adaptable to any other angles of termination from 0–180 degrees, e.g. 45 degrees, 135 degrees, in line or parallel termination, etc. Area a is the mating area for a mating connector, such as that shown at m.

Returning now to FIG. 1, area b is where a coax cable, such as that shown at w, is inserted. Coax cable w consists here of outer conductor o, inner conductor i, and dielectric e. The outer conductor o and inner conductor i of cable w will interface with the embodiment to provide an electrical contact, as will be described further below. Area c provides access for crimping and/or soldering of inner conductor i inserted in b, as will be explained in further detail below. Thus, when wire w is soldered within area c and area a mated with an appropriate mating connector m, connection is made for conduction through the connector.

Figure 2:
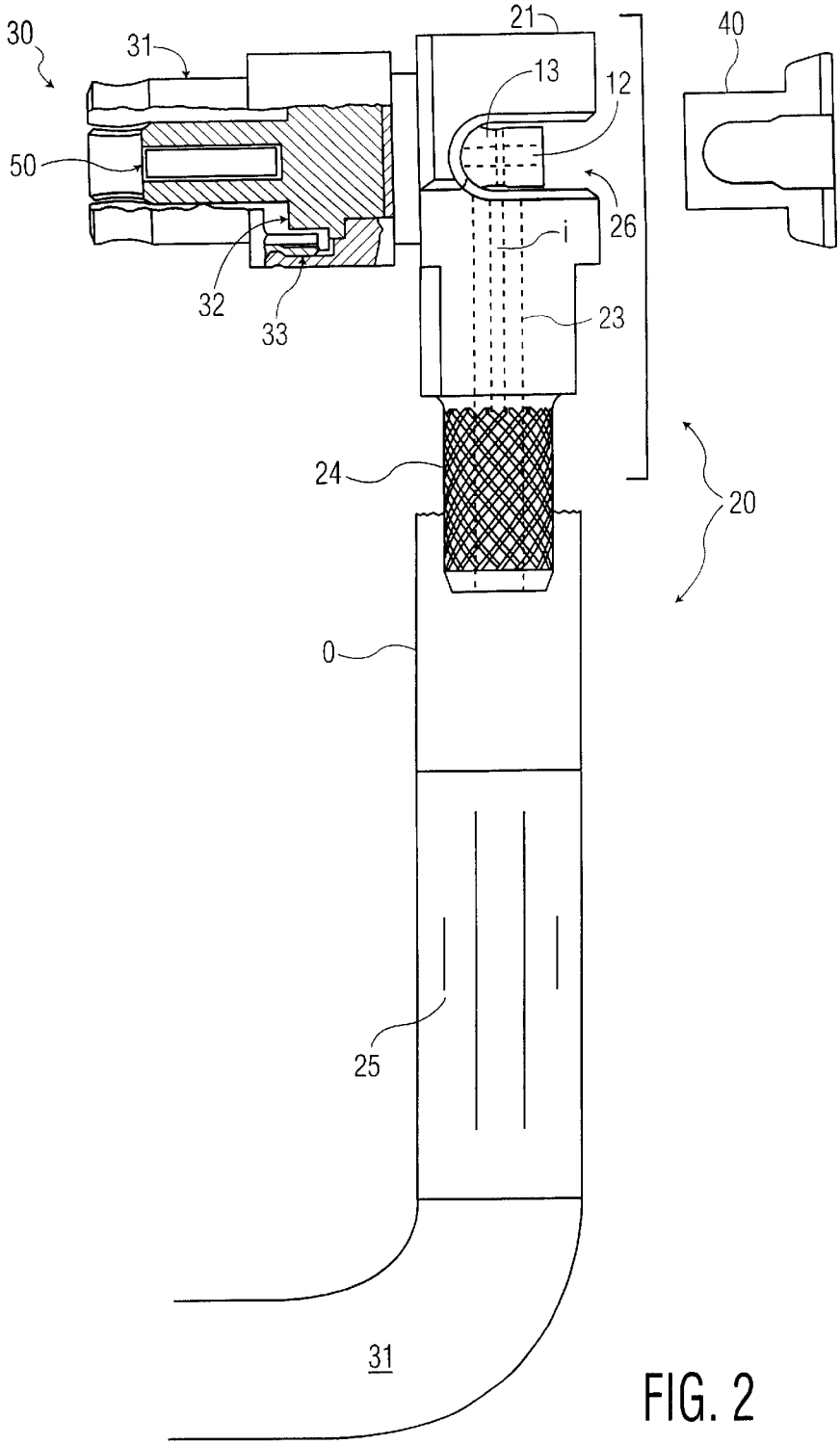
FIG. 2 shows a view of the embodiment of FIG. 1.

Components of the embodiment of FIG. 1 are shown in FIG. 2. Connector housing 30 comprises outer contact 31, configured for mating with a corresponding contact of a mating connector; dielectric 32, providing insulation between the outer contact and core member; retaining ring 33, providing security for retention of the dielectric; and external connector housing 34, which may be configured as desired, for example to mate with an external housing as is further described below.

External connector housing 34, as was mentioned above, may be adapted for installation of an external housing (not shown) that is configured to mate with specific housings. For example, FAKRA keyed connections are known in the art, and so an external FAKRA housing may be employed over housing 34 to mate with a corresponding FAKRA connector.

Outer contact 31, dielectric 32, retaining ring 33 and external connector housing 34 are made of materials as known in the art. For example, outer contact 31 may be stamped or formed, dielectric 32 may be screw machine or molded, retaining ring 33 may be screw machine or drawn and external connector housing 34 may be screw machine or die cast.

The specific shape of a connector housing of any particular embodiment of the present invention is determined by the mating connector with which it is to interact. In the preferred embodiments, these, along with any external housing, are standardized shapes and/or configurations. It should be noted that embodiments may be used, as well, for PCB connection.

Cable housing 20, comprised here of external cable housing 21, surrounding a bore 23, and farther has depending therefrom outer conductor surface 24 and ferrule 25, is connected at a 90 degree angle in this embodiment to connector housing 30. In other embodiments, cable housing 20 and connector housing 30 may be connected at any, desired predetermined degree angle from 0–180 degrees, e.g., 45 degrees, 135 degrees, in line or parallel termination, thus providing a connector adaptable for a variety of cable orientations. Each of these components is made from materials as known in the art. These and other components may be plated as well, and, turning briefly to FIG. 3, recess 26 as well as bores 12, 13 and 23 provide drainage capacity for excess plating.

Returning to FIG. 2, the outer conductor o of a coaxial cable (shown as w) is mounted between outer conductor surface 24 and mating ferrule 25. Cable dielectric e passes into interior bore 23 and terminates. Inner conductor i of cable w passes through interior bore 23, into bore 13 of core member 50, where it will be crimped and/or soldered as will be further described below.

Figure 3:
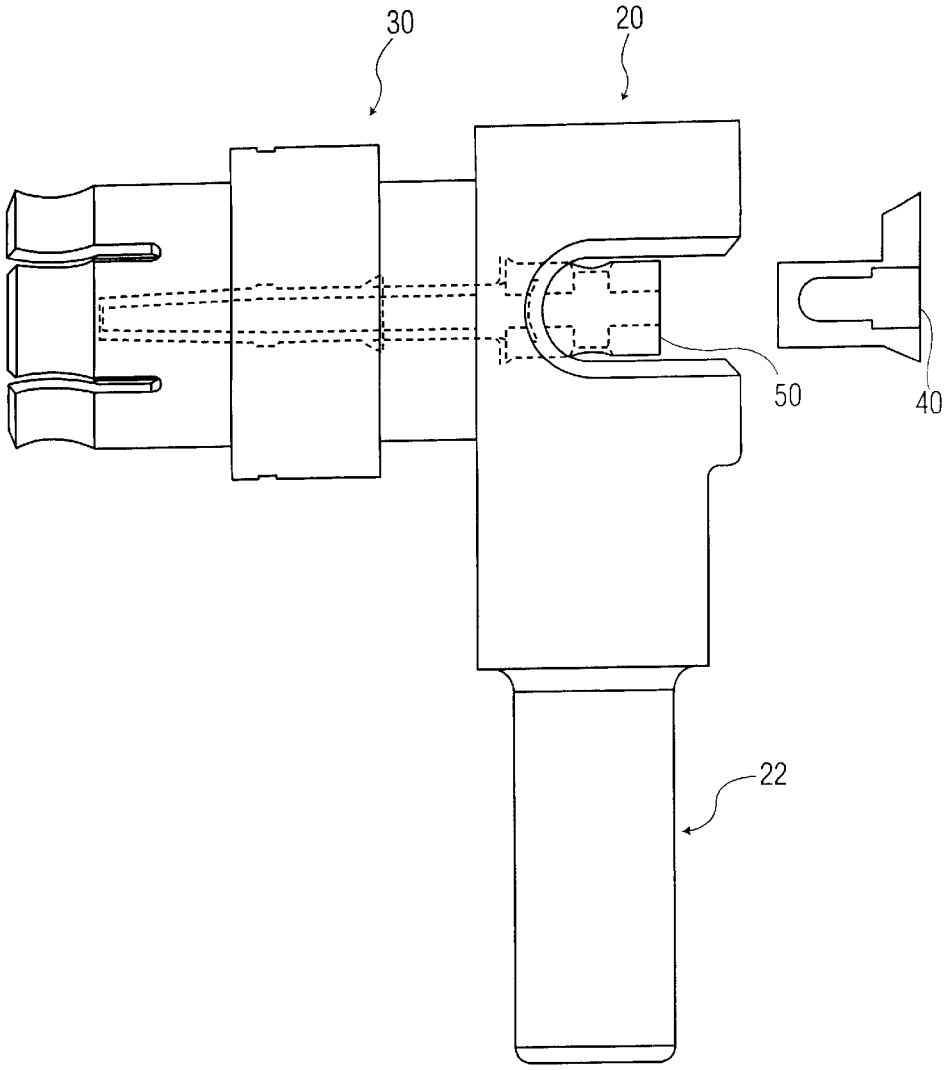
FIG. 3 shows yet another view of the embodiment of FIG. 1.

FIG. 3 shows core member 50 extending within cable housing 20 and connector housing 30, and further extending at least partially into open ended recess 26, whereby it may be accessed in order to permit crimping and/or soldering of a cable inner conductor, as is described further herein.

Figure 4:
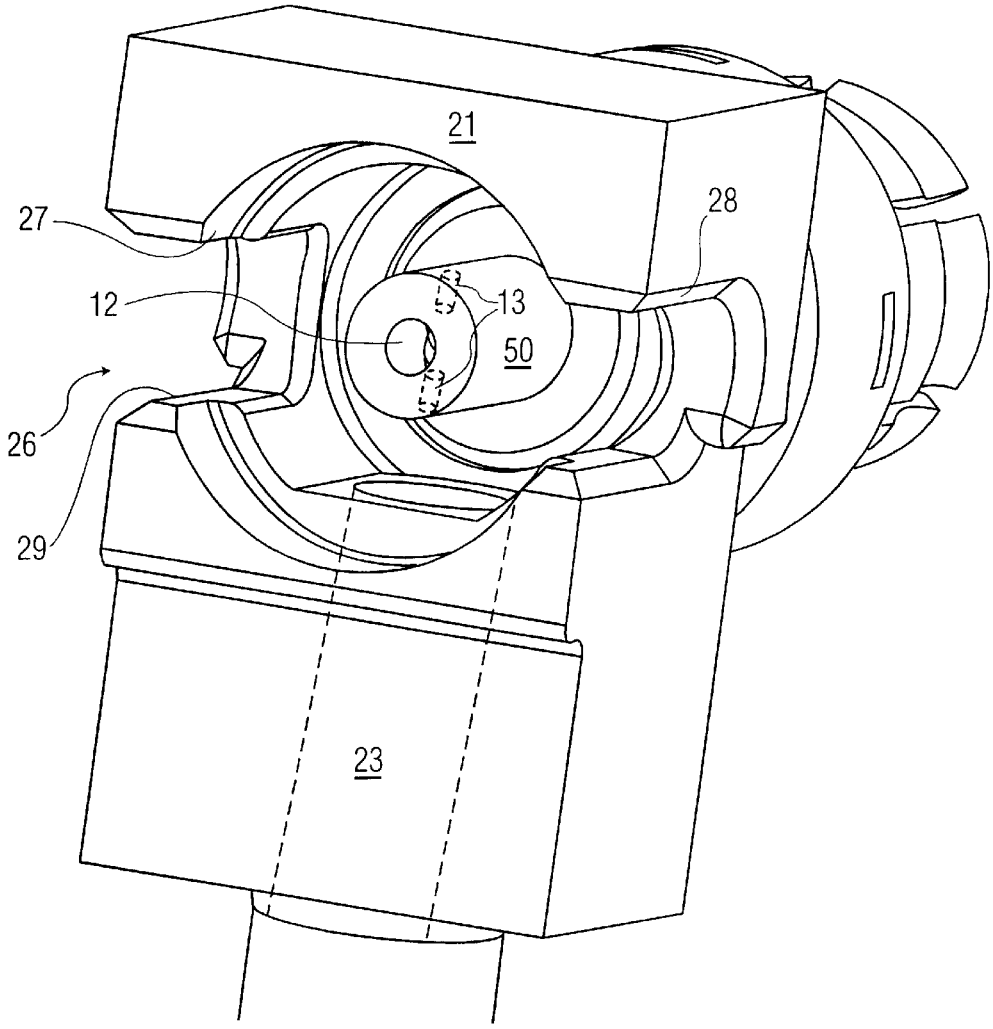
FIG. 4 shows yet another view of the embodiment of FIG. 1.

Turning now to FIG. 4, a rear view of the embodiment of FIGS. 1 and 2 is seen. Open ended recess 26 is shown. Port 27 is a circular opening within external cable housing 21. Cutouts 28 and 29 are U-shaped openings, bounding open ended recess 26, and located on opposite sides of external cable housing 21. When an inner conductor is passed through bore 23, and in turn through bore 13, then cutouts 28 and 29 provide access for crimping. It should be noted that, in other embodiments, no cutouts, a single cutout or multiple cutouts located as desired, may bound open ended recess 26, depending upon the installation means required. For example, in embodiments wherein only soldered connections are made, there may be no cutouts used.

In the preferred embodiment, soldering of the inner conductor to the core member may occur through pre-tinning the inner conductor, feeding the inner conductor into bore 13, and heating the core member 50 to melt the solder, and thereby establish a connection.

Use of bore 13 is especially advantageous for either or both soldering and crimping installation, as it provides a closed guide means for the inner conductor to be fed within core member 50. A closed guide means disposed within a core member, such as bore 13, is used in the preferred embodiments of the present invention, to assist in guiding the inner conductor.

Figure 5:
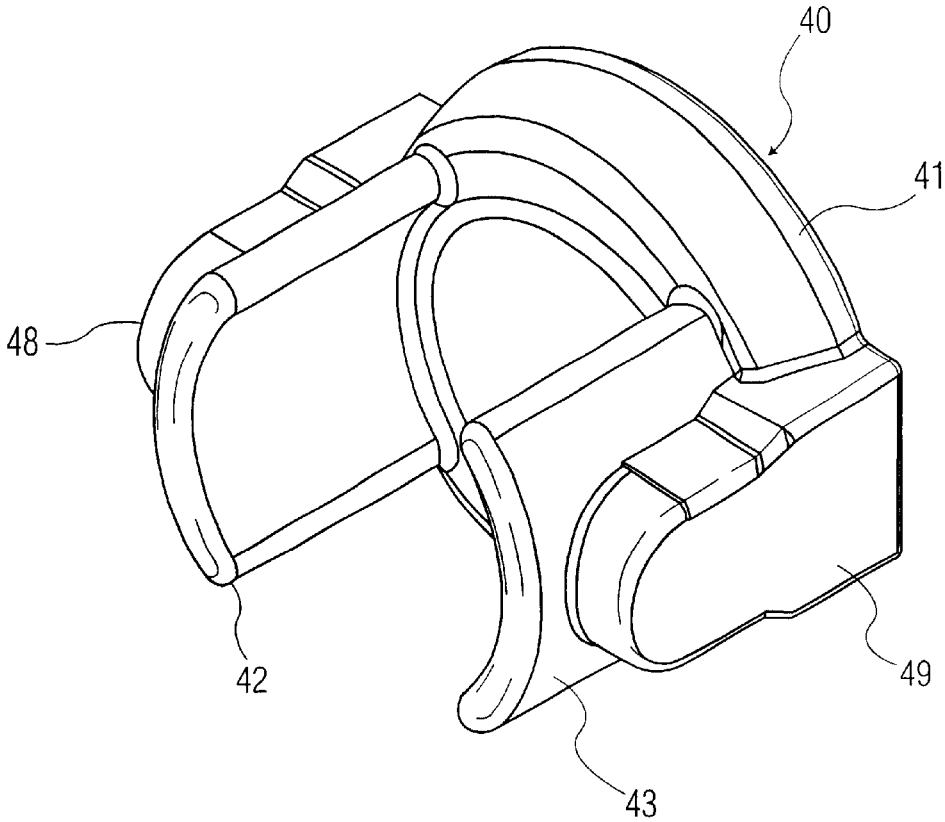
FIG. 5 shows yet another view of the embodiment of FIG. 1.

FIG. 5 shows the cap member 40 of the preferred embodiment of FIG. 1. Cap member 40 is formed to be disposed into open ended recess 26 of external cable housing 21 to provide a cover for access port 27 and cutouts 28 and 29 after the wire has been installed onto core member 50. In this particular embodiment, cap member 40 is comprised of cover 41, flanges 42 and 43 depending therefrom, and mating flanges 48 and 49 depending from flanges 42 and 43 respectively. This particular configuration is appropriate to mate with open ended recess 26 (as shown in FIG. 4) with flange 48 mating with cutout 28 and flange 49 mating with cutout 29. Thus the cap is press fit upon the remaining assembly. It should be noted that the configuration of a cap member, and installation thereon, in any given embodiment is dependant upon the configuration of the open ended recess in that embodiment, so that the two are in complimentary mating configuration. It should also be noted that, by use of unitary cap member in this and other embodiments, a single means is provided for sealing the access area, thus simplifying assembly.

It should be noted that other embodiments may utilize cable to cable connection, such as, for example, where a connector housing component is configured to mate with the appropriate connector on a cable, as well as cable—PCB connection, such as, for example where a connector housing component is configured to mate with the appropriate connector on a PCB. Therefore, the term "connector housing," as used herein, is intended to include those embodiments that are configured to connect to a cable as well as those configured to connect to a printed circuit board, and, similarly, the term "mating connector" is intended to include cable and printed circuit board connectors.

The above description and the views and material depicted by the figures are for purposes of illustration only and are not intended to be, and should not be construed as, limitations on the invention.

Moreover, certain modifications or alternatives may suggest themselves to those skilled in the art upon reading of this specification, all of which are intended to be within the spirit and scope of the present invention as defined in the attached claims.

We claim:

1. A coaxial cable connector, comprising:

a connector housing for interfacing with a mating connector, a cable housing, connected to said connector housing, having an open ended recess, a core member, having disposed therein at least one first bore for receiving a coax cable inner conductor and at least one second bore, said at least one first bore surrounded by a continuous surface of said core member, wherein said core member extends within said connector housing and said cable housing, and further extends at least partially into said open ended recess so that said core member is accessible through said open ended recess, said at least one second bore extending through a central portion of said core member and intersecting said at least one first bore, and, a cap, for sealing said open ended recess upon installation of said inner conductor of said coax cable.

2. A coaxial cable connector as in claim 1, whereby said cable housing is further comprised of an external cable housing, surrounding a bore, with an outer conductor surface and ferrule depending from said external cable housing.

3. A coaxial cable connector as in claim 1, whereby at least one cutout bounds said open ended recess of said cable housing.

4. A coaxial cable connector as in claim 1, whereby said cap is press fit into said open ended recess.

5. A coaxial cable connector as in claim 1, whereby said cap includes a portion being of smaller diameter than a diameter of said open ended recess, so that said portion is received within said open ended recess.

6. A coaxial cable connector as in claim 1, whereby said connector housing is connected to said cable housing at a predetermined angle.

7. A coaxial cable connector as in claim 1, whereby said connector housing is connected to said cable housing at a predetermined angle from 0–180 degrees.

8. A coaxial cable connector as in claim 1, whereby said connector housing is further comprised of:

an outer contact, configured for mating with a corresponding contact of a mating connector;

a dielectric for insulating said outer contact from said core member; and, an external connector housing.

9. A coaxial cable connector as in claim 8, whereby said external connector housing is adapted for installation of an external housing.

10. A coaxial cable connector of claim 1, wherein said continuous surface of said core member is substantially circular in cross-section.

11. A coaxial cable connector of claim 10, wherein said continuous surface of said core member is substantially cylindrical and includes openings at opposing ends.

12. A method for installing a coaxial cable connector with a mating connector and coax, comprising:

interfacing a connector housing with said mating connector, introducing said cable into a cable housing, whereby said cable housing is connected to said connector housing, and further wherein said cable housing has an open ended recess, installing a core member to an inner conductor of said coax, whereby said core member has disposed therein at least one first bore for receiving said inner conductor and at least one second bore, said at least first one bore surrounded by a continuous surface of said core member, and further wherein said core member extends within said connector housing and said cable housing, and further extends at least partially into said open ended recess so that said core member is accessible through said open ended recess, said at least one second bore extending through a central portion of said core member and intersecting said at least one first bore, and, sealing said open ended recess upon installation of said inner conductor of said coax cable by inserting a cap into said open ended recess.

13. A method as in claim 12 for installing a coaxial cable connector, whereby said installing occurs by soldering.

14. A method as in claim 12 for installing a coaxial cable connector, whereby said installing occurs by crimping.

15. A connection created accorded to the method of claim 12.

16. A coaxial cable connector, comprising:

a connector housing for interfacing with a mating connector, a cable housing, connected to said connector housing, having an open ended recess, a core member, having disposed therein at least one first bore and at least one second bore, said at least one first bore for receiving a coax cable inner conductor, and said at least one second bore extending through a central portion of said core member and intersecting said at least one first bore, wherein said core member extends within said connector housing and said cable housing, and further extends at least partially into said open ended recess so that said core member is accessible through said open ended recess, and a cap, press fit within said open ended recess upon installation of said inner conductor of said coax cable.

17. A coaxial cable connector of claim 16, wherein said cap includes a portion being of smaller diameter than a diameter of said open-ended recess, so that said portion is received within said open-ended recess.

18. A coaxial cable connector of claim 16, wherein said cap comprises a cover, one or more flanges depending from the cover and one or more mating flanges depending from said flanges.

19. A coaxial cable connector of claim 16, wherein said closed guide comprises at least one bore surrounded by a continuous surface of said core member.

20. A coaxial cable connector of claim 19, wherein said continuous surface of said core member is substantially cylindrical and includes openings at opposing ends.

* * * * *